United States Patent [19]

Roossine et al.

[11] Patent Number: 4,482,944

[45] Date of Patent: Nov. 13, 1984

[54] FLEXIBLE LIGHT STRIP ASSEMBLY

[76] Inventors: Isaiah C. Roossine; Willem Wirtz, both of 228 Phipps Plz., Palm Beach, Fla. 33480

[21] Appl. No.: 467,848

[22] Filed: Feb. 18, 1983

[51] Int. Cl.[3] ..... F21S 1/02; F21S 3/02

[52] U.S. Cl. ..... 362/418; 362/430; 362/220; 362/225; 362/250; 362/252; 362/806; 339/59 L; 339/61 L; 339/177 L; 339/206 L; 339/208

[58] Field of Search ..... 339/17 D, 59 L, 61 L, 339/177 L, 206 L, 208, 210 T; 362/252, 227, 806, 430, 220, 225, 250

[56] References Cited

U.S. PATENT DOCUMENTS

| | | | |
|---|---|---|---|
| 2,595,929 | 5/1952 | Dartt | 362/806 |
| 2,726,293 | 12/1955 | Bramming | 339/206 L |
| 3,036,206 | 5/1962 | Holbrook | 362/806 |
| 3,143,301 | 8/1964 | Trautner et al. | 362/242 |
| 3,500,036 | 3/1970 | Szentveri | 362/242 |
| 3,527,933 | 9/1970 | Thummel | 362/249 |
| 3,676,834 | 7/1972 | Kaldor et al. | 339/59 L |
| 3,858,162 | 12/1974 | Mai et al. | 339/208 |
| 3,894,225 | 7/1975 | Chao | 362/249 |
| 3,950,061 | 4/1976 | Kausen | 339/93 L |
| 3,955,872 | 5/1976 | Brudy | 339/208 |
| 3,968,398 | 7/1976 | Lehmann et al. | 362/806 |
| 4,101,187 | 7/1978 | Collier | 339/59 L |
| 4,107,767 | 8/1978 | Anquetin | 362/236 |
| 4,114,972 | 9/1978 | Kraus et al. | 339/65 |
| 4,173,035 | 10/1979 | Hoyt | 362/249 |
| 4,181,390 | 1/1980 | Aizawa | 339/65 |
| 4,228,486 | 10/1980 | Matsuya | 362/252 |
| 4,262,980 | 4/1981 | Heritage | 339/1 L |
| 4,264,117 | 4/1981 | Pritulsky | 339/97 L |
| 4,335,422 | 6/1982 | Van Ess | 362/806 |

OTHER PUBLICATIONS

Advertisement, "The Willem Wirtz Associates Flexible Light Strip".

Advertisement, "The Ultimate in Strip Lighting", Willem Wirtz Associates.

Data Booklet, "RIBBONLITE TM The Flexible Light Strip of Willem Wirtz Associates", (Revised 5/80).

*Primary Examiner*—Stephen J. Lechert, Jr.

*Assistant Examiner*—Howard J. Locker

*Attorney, Agent, or Firm*—Saidman, Sterne & Kessler

[57] ABSTRACT

A flexible light strip assembly includes a plurality of sockets and a pair of flexible conductive elements to which the sockets are attached. A pair of unitary, substantially identical electrical contacts are disposed in a 180° relationship or, alternatively, in a mirror image relationship within each socket to respectively provide vertical or horizontal bulb arrangements. The contacts pass through each socket for attachment to the conductive elements and are adapted to receive a conventional wedge base bulb. An optional raceway, cover, and mounting bracket facilitate installation of the light strip.

41 Claims, 9 Drawing Figures

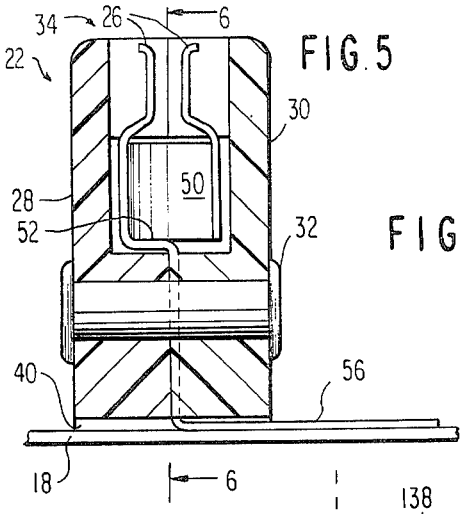
FIG. 5
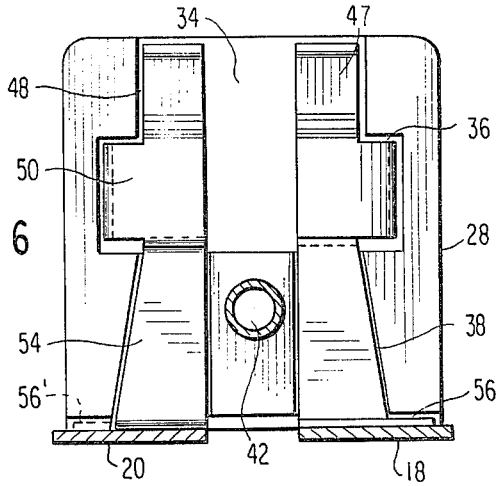
FIG. 6
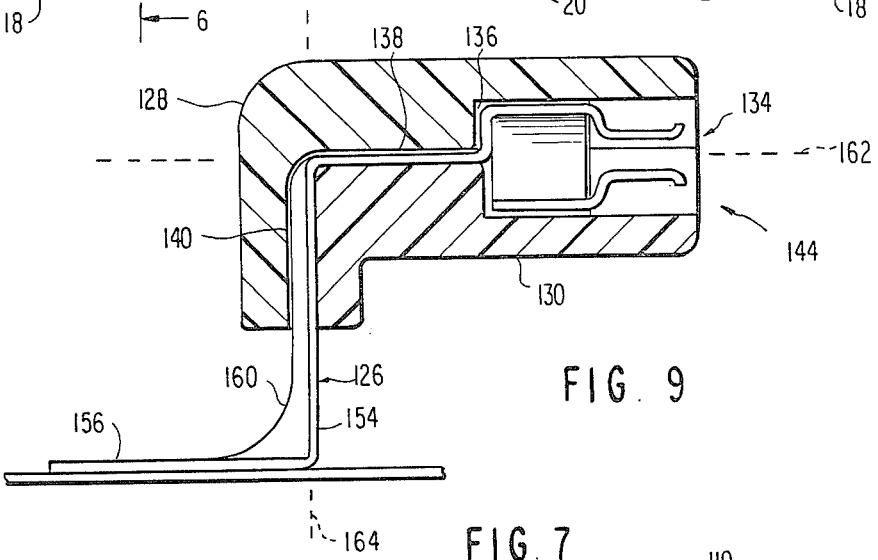
FIG. 9
FIG. 7
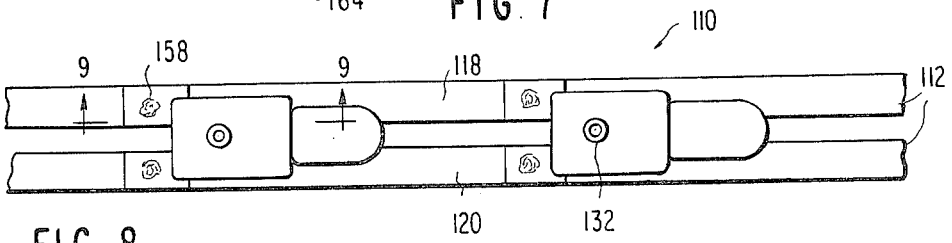
FIG. 8
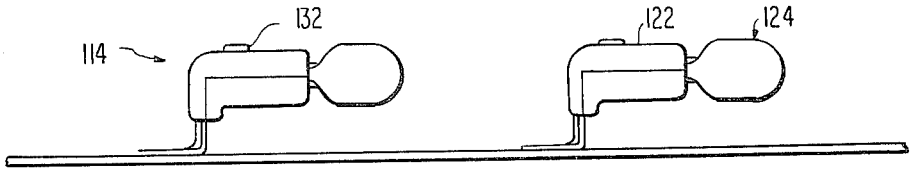

FLEXIBLE LIGHT STRIP ASSEMBLY

BACKGROUND OF THE INVENTION

1. Field of the Invention

The present invention is related to light assemblies, and more particularly is directed towards flexible light strip assemblies.

2. Description of the Related Art

Wedge base bulbs or lamps are finding use in increasing numbers of applications. This type of bulb has a glass envelope containing a filament, with the wedge base of the envelope designed to be inserted into an appropriately formed socket. Such bulbs are generally easier to manufacture than conventional screw type or bayonet type bulbs because it is unnecessary to form and attach a separate, conductive base to the lamp. Instead, conductors to the filament extend through the wedge base of the envelope and are bent over the external surface of the wedge base. Such lamps take up relatively little space, and electric current is passed through the filament as the conductors are brought into a circuit through connection with various electrical contact members. Proper positioning of these conductors is essential to correct operation of the lamp.

Because of economies of manufacture, as mentioned above, and the availability of various transformer power supplies to provide various current ratings to these lamps, they are presently utilized for diverse applications. While sockets for wedge base bulbs are known in the art (see, for example, U.S. Pat. Nos. 4,101,187, 3,950,061, and 4,181,390), they typically require coupling of the electric contact members to the bulb's conductors by the use of wires that are crimped or soldered to contact members within the socket housing. This disadvantageously requires a multi-step process to couple the bulb conductors, the contacts and their lead wires; and precludes the effective use of molded plastic housings which may not be capable of withstanding the relatively high temperatures required for soldering or welding lead wires to the electric contacts.

Two-piece socket assemblies are also known; however, the assembly disclosed, for example, in the U.S. Pat. No. 4,101,187 (listed above) requires the lead wires that supply electric power to the lamp to be crimped to electric contact members within the socket. This disadvantageously requires an additional manufacturing step.

Sockets having contacts that releasably grip the base and sides of a wedge base bulb, the contacts of which extend through the socket housing, are shown, for example, in U.S. Pat. No. 4,114,972. This advantageously eliminates the necessity for coupling contacts to lead wires within the socket; however, this patent is directed towards the problem of alignment of the bulbs as they are inserted in the socket, and the contact members disclosed would not be useful in the construction of the flexible light strip assembly of the present invention.

Flexible light strip devices are known (see, for example, U.S. Pat. Nos. 3,500,036; 3,527,933; 3,894,225; 4,107,767; and 4,173,035). Flat electrical connecting elements are disclosed in the U.S. Pat. No. 3,527,933 which, however, must be pre-formed with openings aligned in pairs to receive connecting members from the bulb socket utilized. The U.S. Pat. No. 3,500,036 discloses a strip lighting device in which bores must be formed to accomodate a socket and a lamp. Our prior RIBBONLITE brand flexible light strips utilized a bayonet base socket to which contact members were fastened. These in turn were soldered to a pair of parallel copper conductive elements. However, none of these related devices allow the simple and economical utilization of a conventional wedge base bulb, and a plastic molded housing assembly through which unitary contact members extend, to safely and conveniently fasten the socket assemblies to an unmodified conductive strip.

SUMMARY OF THE INVENTION

The foregoing disadvantages are overcome by the present invention through the provision of a socket for a bulb having a wedge base which includes a housing having two substantially identical halves, and a bulb-receiving cavity adapted to receive the bulb along the socket's longitudinal axis. The socket further includes means for fastening the halves together, and first and second substantially identical electrical contacts. The contacts are electrically separated and disposed within the housing such that each contact is oriented approximately 180° with respect to the other measured about the longitudinal axis.

The contacts each comprise an internal portion contained within the housing and an external portion which extends outwardly from the housing along the longitudinal axis. The external portion terminates in a foot that is substantially perpendicular to the axis, and the foot of the first contact extends in a substantially opposite direction from the foot of the second contact.

In accordance with other aspects of the present invention, the internal portion of each contact includes a bulb-receiving portion that comprises means for receiving and releasably retaining the wedge base bulb. The latter means in turn comprises a flexible spring clip.

In accordance with other aspects of the present invention, the housing halves further include recess means for accommodating the contacts within the housing when the halves are joined together by the fastening means, which may in turn comprise a rivet.

In accordance with more detailed aspects of the present invention, the bulb-receiving portion includes a U-shaped support for the spring clip, the latter extending from the support upwardly along the longitudinal axis, and a leg that extends from the U-shaped support downwardly along the axis through the housing to form the external portion of the contact and terminating in the foot.

In accordance with another aspect of the present invention, there is provided a light assembly for wedge base bulbs which includes first and second elongated, substantially parallel, electrically-separated conductive elements, and a plurality of sockets disposed along the elements. Each socket includes a housing having two substantially identical halves, a longitudinal axis, and a bulb-receiving cavity adapted to receive a wedge base bulb substantially parallel to the longitudinal axis. The housing halves are fastened together by means such as a rivet.

Each socket includes a pair of substantially identical electrical contacts each having an internal portion contained within the housing and an external portion that extends outwardly from the housing. The internal portion of each contact includes a bulb-receiving portion and the external portions of the contacts are physically and electrically coupled to the first and second conductive elements, respectively. The contacts are electrically separated and disposed within the housing such that each is oriented approximately 180° with respect to the other measured about the longitudinal axis. The external portion of the contacts are physically and electrically coupled to the first and second conductive elements, respectively. These conductive elements are preferably flexible.

In accordance with yet another aspect of the present invention, there is provided a light assembly for wedge base bulbs that includes two parallel, elongated, flexible, conductive elements, and a plurality of sockets mounted to these elements that are adapted to receive the bulbs. The light strip may optionally include means for holding the conductive elements coupled to means for covering the elements. The cover includes an aperture through which the socket may extend in a direction substantially perpendicular to the conductive elements.

The holding means may include a raceway that has two sides and a base, the base having a recess to accommodate the conductive elements. The cover is U-shaped having a top and two walls that depend downwardly therefrom. The cover is coupled to the raceway forming a hollow chamber between the raceway and the top of the cover. The walls of the cover each have a lip at their lower ends at the point where the cover is coupled to the raceway, and each side of the raceway has an indentation to reversibly mate and interlock with a corresponding lip of the cover.

In accordance with a more detailed aspect of the present invention, an optional mounting bracket may be provided having a bottom and two edges. For use with this mounting bracket, the raceway base preferably includes raised strips that form at least one hollow chamber between the base and the bracket bottom when the light assembly is coupled to the bracket.

In accordance with an additional aspect of the present invention, a light assembly for wedge base bulbs is provided which includes two parallel, flexible, elongated conductive elements, and a plurality of sockets that are cantilevered to the elements and are adapted to receive wedge base bulbs. Each socket in this embodiment has a horizontal axis and a vertical axis, and a housing including two housing pieces. The socket also has a bulb-receiving cavity adapted to receive a bulb substantially parallel to the horizontal axis. The sockets each also have a pair of contacts substantially similar to each other and disposed within the housing in a mirror-image relationship. They are mounted to the conductive elements to extend in a cantilever manner along the vertical and horizontal axes.

These contacts each also include a bulb-receiving portion, a leg, and a foot by which the contact and socket are fastened to its associated conductive element. In accordance with this embodiment, the leg preferably includes reinforcing rib means for supporting the contact in a cantilever fashion on its associated conductive element.

BRIEF DESCRIPTION OF THE DRAWINGS

The foregoing and other objects, aspects, features and advantages of the present invention will be better understood from the following detailed description thereof when considered in conjunction with the accompanying drawings, in which:

FIG. 5 is a sectional view taken along line 5—5 of FIG. 2;

FIG. 6 is a sectional view taken along line 6—6 of FIG. 5;

FIG. 7 is a top view of an alternate embodiment of the flexible light strip assembly of the present invention;

FIG. 8 is a side view of the alternate embodiment of FIG. 7; and

FIG. 9 is a sectional view taken along line 9—9 of FIG. 7.

DETAILED DESCRIPTION OF THE PREFERRED EMBODIMENTS

Figures 1, 2, 3, 4:
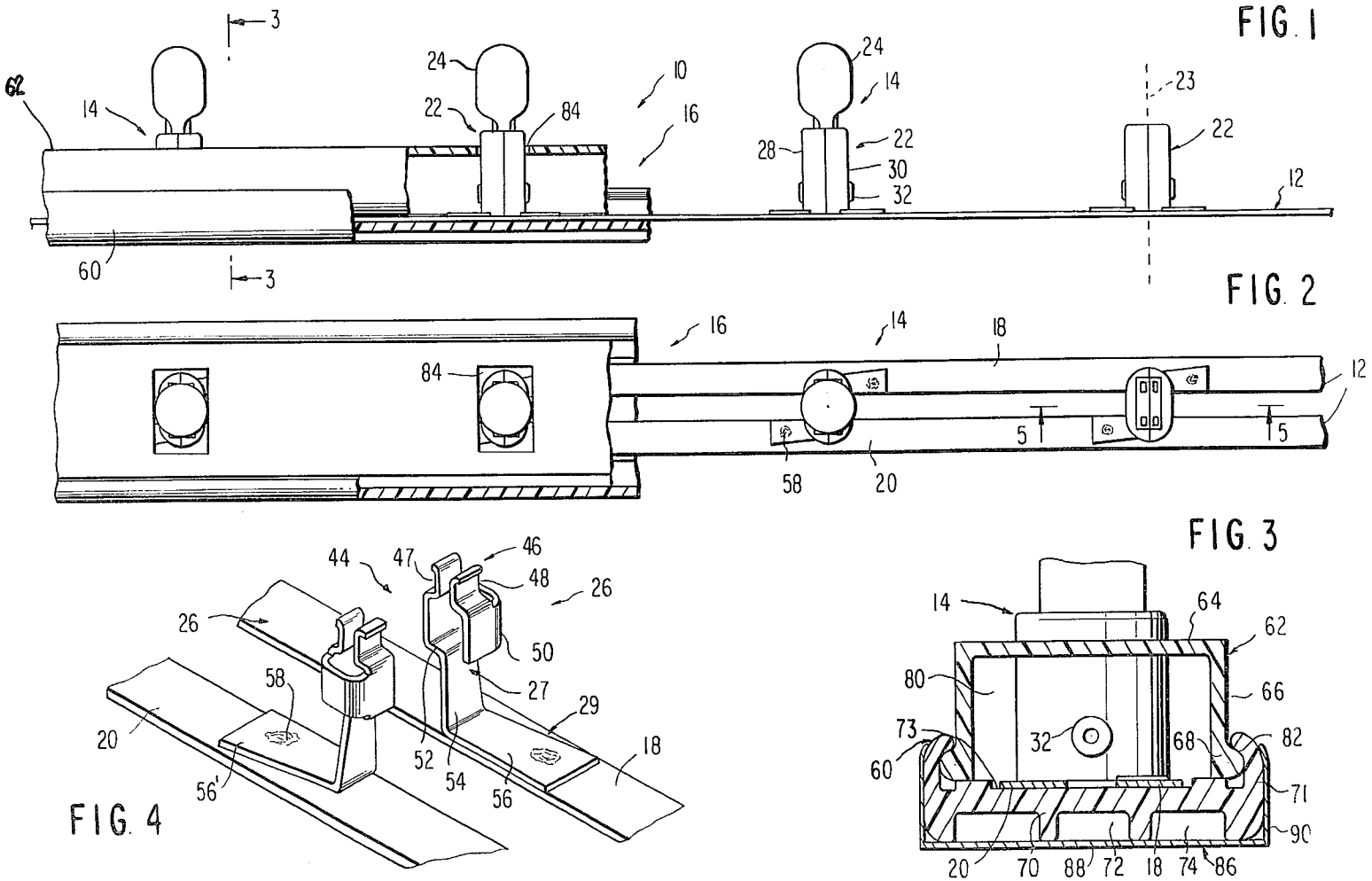
FIG. 1 is a side view, partially broken, of a flexible light strip assembly in accordance with a preferred embodiment of the present invention.
FIG. 2 is a top view of the flexible light strip assembly of FIG. 1.
FIG. 3 is a cross-sectional view taken along line 3—3 of FIG. 1.
FIG. 4 is a perspective view of the contacts and conductive elements of the present invention.

Referring now to the drawings, wherein like reference numerals represent identical or corresponding parts throughout the several views, and more particularly to FIGS. 1 and 2, there is shown a flexible light strip assembly generally designated by reference numeral 10.

Assembly 10 has the following major components: a pair of parallel, elongated, flexible conductive elements, generally indicated at 12; a plurality of socket and lamp assemblies, generally indicated at 14; and an optional raceway and cover assembly, generally indicated at 16 (which will be discussed later).

Conductive elements 12 include a first conductive element 18 and a second conductive element 20. These elements may conventionally be formed of any conductive metal, such as copper. Most preferably, they are formed from tin-plated copper busses.

Socket and lamp assemblies 14 each include a conventional wedge base bulb 24 and a socket 22 electrically coupled to conductive elements 18 and 20 in a parallel circuit, so that if one socket or bulb becomes inoperative, the remainder will not be affected.

Each socket 22 includes a first housing half 28 and a second housing half 30 which are joined by a rivet 32 formed from stainless steel, for example. Socket 22 has a longitudinal axis indicated by dotted line 23. Housing halves 28 and 30 are preferably formed of a glass-filled polyester material or its equivalent. Certain internal features of housing halves 28 and 30 are discussed below.

Each socket 22 is adapted to receive a conventional T-3¼ wedge base incandescent bulb (or lamp) 24 in any suitable voltage from, e.g., 2 v to 28 v. An example of such an incandescent bulb is the #585 28-volt lamp or the #159 6.3-volt lamp.

Socket 22 also includes, as shown in FIG. 4, a pair of unitary, preferably tin-plated copper electrical contacts, each shown generally at 26, that extend through each socket 22. For ease in illustration, contacts 26 are shown in FIG. 4 with socket housing halves 28 and 30 removed. The pair of contacts 26 used in a single socket 22 are substantially identical to each other but are electrically separated and disposed within socket 22 such that each contact 26 is oriented approximately 180° with respect to the other, measured about longitudinal axis 23. This results in a vertical bulb orientation for this embodiment.

Contacts 26 each include an internal portion generally indicated at 27 that is contained within socket housing halves 28 and 30, and an external portion generally indicated at 29 that extends outwardly from housing halves 28 and 30.

Each internal portion 27 includes a bulb-receiving portion 44 that receives and releasably retains a wedge base bulb. Bulb-receiving portion 44 includes a flexible spring clip, generally indicated at 46, having a first arm 47 and a second arm 48. Spring clip 46 extends upwardly along longitudinal axis 23. Bulb-receiving portion 44 also includes a U-shaped support 50 for arms 47 and 48 and an offset portion 52 that connects support 50 and a leg 54.

Leg 54 extends downwardly through socket 22 so that external portion 29 includes a lower part of leg 54. Leg 54 also is preferably slightly flared in a downwardly direction and terminates in a foot 56 that is substantially perpendicular to longitudinal axis 23. As shown in FIG. 4, foot 56 of one contact extends in an opposite direction along conductive element 18 from the direction that foot 56' of the other contact extends along parallel conductive element 20. Foot 56 preferably flares outwardly from leg 54 to its free end.

Each contact 26 is fastened to its respective conductive element 18, 20 by spot welding, for example, as indicated in FIGS. 2 and 4 at 58. Alternatively, the contacts can be fastened to the elements by riveting or soldering.

Housing halves 28 and 30 are adapted to receive a wedge base bulb as indicated above, and also accomodate contact pair 26. Now referring more particularly to FIGS. 5 and 6, socket 22 is shown in greater detail to include a cavity 34 to receive the wedge base bulb, a transversely-extending rectangular recess 36 for accomodating U-shaped supports 50 of contacts 26, and a flared recess 38 to accommodate legs 54 of contacts 26. A base recess 40 allows feet 56 and 56' of contacts 26 to exit from socket 22. When fastened by rivet 32 that extends through a bore 42, housing halves 28 and 30 firmly hold contacts 26 in place.

An optional raceway and cover assembly 16 is illustrated in FIGS. 1, 2 and 3. Referring particularly to FIG. 3, raceway and cover assembly 16 has two main components: a raceway 60 to hold socket and lamp assemblies 14 and conductive elements 12, and a U-shaped cover generally indicated at 62. Raceway 60 has a base 70 and two sides 71. Base 70 includes a recess 73 for accomodating conductive elements 18 and 20 which may be fastened to base 70 by conventional means, such as adhesives or double-faced tape. Cover 62 has a top 64 and two downwardly depending walls 66 each having a lip 68 at its lower edge. Sides 71 each have an indentation 82 to reversibly mate and interlock with a corresponding lip 68 of cover 62. A hollow chamber 80 is formed when cover 62 and raceway 60 are coupled. Socket and lamp assemblies 14 extend through apertures 84 in top 64 (seen most clearly in FIG. 2) in a direction substantially perpendicular to conductive elements 18 and 20.

Raceway and cover assembly 16 may also include an additional, optional component: a mounting bracket generally indicated at 86. Mounting bracket 86 is a thin, U-shaped component having a bottom 88 and two edges 90. Mounting bracket 86 is useful when added fastening support is needed to install the flexible light strip assembly of the present invention. In use, mounting bracket 86 is fastened to a support structure, as for example, the inner wall of a china cabinet, through the use of screws or nails passing through bottom 88. Edges 90 are gently spread outwardly apart and the basic flexible light strip assembly 10 is inserted therein, following which edges 90 are released to snugly confine the flexible light strip assembly in place. Thus, in the embodiment shown in FIG. 3, raceway base 70 has a central groove 72 to provide clearance for the head of the screw or nail (not shown) passing through bracket 86 beneath it. Base 70 of raceway 60 also preferably includes two peripheral grooves 74 that provide clearance for additional screws or nails if they are needed.

In an alternate embodiment of the raceway and cover assembly (not illustrated) for which the additional fastening support of mounting bracket 86 is not desired, base 70 has a smooth lower surface. In this way, assembly 10 may be fastened to its support structure by applying a double-faced tape to base 70 and adheringly applying the assembly to a wall, for example.

An alternate embodiment of the flexible light strip assembly of this invention is illustrated in FIGS. 7 through 9 to which attention is now directed. The light strip assembly of this embodiment is generally indicated at 110. It includes a current supply in the form of paired conductive elements generally indicated at 112. Similar to the first embodiment, conductive elements 112 include a first conductive element 118 and a second conductive element 120. A plurality of socket and lamp assemblies 114 are coupled to elements 112 and each includes a socket generally indicated at 122 and a wedge base bulb 124. Each socket 122 includes a housing having pieces 128 and 130, and a pair of tin-plated copper electrical contacts 126 disposed in a mirror-image relationship within the housing. In this embodiment, each socket 122 is configured in a cantilevered manner with respect to conductive elements 112, which results in a generally horizontal bulb configuration.

As shown in FIG. 9, contacts 126 each include a bulb-receiving portion 144, a foot 156, and a leg 154 connected therebetween. Bulb-receiving portion 144 is substantially similar to bulb-receiving portion 44 of the first embodiment. Leg 154 extends from bulb-receiving portion 144 first along a horizontal axis 162 and second at a right angle thereto downwardly along a vertical axis 164, thereby forming the cantilevered support structure. Leg 154 preferably also includes a reinforcing rib 160 to provide extra support and stability to cantilevered socket and lamp assembly 114. Foot 156 may be offset from leg 154 or flared outwardly therefrom. In this alternate embodiment, foot 156 of each contact 126 extends in the same direction along their respective conductive elements 118 and 120, and are welded, riveted, or soldered thereto as at 158.

Housing pieces 128 and 130 are generally L-shaped and are fastened together by a rivet 132 to tightly retain contacts 126 therewithin. A cavity 134 is provided within each socket 122 to receive bulb 124, in a manner similar to cavity 34 of the first embodiment. Pieces 128 and 130 include a rectangular recess 136 to accomodate bulb-receiving portion 144 of contact 126, and horizontal and vertical recesses 138 and 140 to accomodate leg 154.

By virtue of the foregoing, we have provided an improved, unique flexible light strip assembly which permits greater flexibility then heretofore possible by virtue of the ability of the sockets to hold the rugged, miniature T-3¼ wedge base lamps. This flexibility permits the present invention to follow virtually any arc or spiral configuration. The sockets are preferably spaced at 2 to 2.5 inch intervals along the conductive elements although they can be spaced closer or farther apart. With commercially available, easily insertable wedge base lamps, the sockets can deliver widely variable wattages at various voltages in a very compact configuration. When lamps of various intensities are available in a single voltage, the same light strip of the present invention can be lamped with different intensities with a single transformer power pack. This feature helps to solve critical lumen control. Also, if desired, the sockets of the present invention may be spot welded, riveted or soldered at individually desired locations to meet custom lighting requirements. Clearly, the vertical and horizontal sockets can be interspersed on the conductive elements in any desired manner to meet individual needs.

The uniquely small dimensions of the present invention are very significant. For example, the height of the sockets in the first embodiment is preferably 11/16 inch which, together with a bulb, creates an overall height from the busses to the top of the bulb of only 1 5/16 inches. The overall width of the two conductive elements is preferably only 21/32 inch. In the second embodiment (FIGS. 7–9), the distance from the busses to the top of the socket is preferably only about 0.70 inch, the width of the socket itself being about 0.56 inch. It may be appreciated that such dimensions permit use of the present invention in areas heretofore inaccessible.

It also may be appreciated that while the first embodiment is principally designed for unshielded use, its structure may be concealed by the unique raceway and cover assembly, thereby leaving only the bulb visible.

While the invention has been described with respect to the preferred embodiments shown herein, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

We claim as our invention:

1. A socket for a bulb having a wedge base, comprising:

a housing having two substantially identical halves, a longitudinal axis, and a bulb-receiving cavity adapted to receive the bulb substantially parallel to said axis;

means for fastening said housing halves together; and first and second substantially identical electrical contacts in said housing, said contacts being electrically separated and disposed within said housing such that each contact is oriented approximately 180° with respect to the other, measured about said axis, each of said contacts terminating in a foot substantially perpendicular to said axis, said foot of said first contact extending in a substantially opposite direction from said foot of said second contact.

2. The socket of claim 1, wherein said contacts each comprise:

an internal portion contained within said housing; and an external portion extending outwardly from said housing.

3. The socket of claim 2, wherein said external portion extends outwardly from said housing along said axis.

4. The socket of claim 3, wherein said internal portion includes a bulb-receiving portion.

5. The socket of claim 4, wherein said bulb-receiving portion further comprises means for receiving and releasably retaining the bulb.

6. The socket of claim 5, wherein said receiving and retaining means comprises a flexible spring clip.

7. The socket of claim 6, wherein said housing halves further include recess means for accomodating said contacts within said housing when said housing halves are joined together by said fastening means.

8. The socket of claim 7, wherein said bulb-receiving portion comprises:

a U-shaped support for said spring clip, said clip extending from said U-shaped support upwardly along said axis; and a leg extending from said U-shaped support downwardly along said axis through said housing to form said external portion and terminating in said foot.

9. The socket of claim 8, wherein said foot flares outwardly from said leg.

10. A light assembly for wedge base bulbs, comprising:

first and second elongated, substantially parallel, electrically-separated conductive elements;

a plurality of sockets disposed along said elements, each socket including a housing having two substantially identical halves, a longitudinal axis, and a bulb-receiving cavity adapted to receive a wedge base bulb substantially parallel to said axis;

means for fastening said housing halves together;

first and second substantially identical electrical contacts in each said housing;

said conductive elements serving both as means for supporting said sockets and means for conducting electricity to said contacts;

said contacts each having an integral portion contained within said housing and an external portion extending outwardly from said housing;

said internal portion including a bulb-receiving portion;

said contacts being electrically separated and disposed within said housing such that each is oriented approximately 180° with respect to the other measured about said axis; and said external portion of said first and second contacts being physically and electrically coupled to said first and second conductive elements, respectively.

11. The light assembly of claim 10, wherein said axis is substantially perpendicular to said conductive elements.

12. The light assembly of claim 11, wherein said conductive elements are flexible.

13. The light assembly of claim 12, wherein said external portion extends outwardly from said housing along said axis.

14. The light assembly of claim 13, wherein said external portion terminates in a foot substantially perpendicular to said axis, said foot of said first contact extending in a substantially opposite direction from said foot of said second contact.

15. The light assembly of claim 14, wherein said bulb-receiving portion further comprises means for receiving and releasably retaining the bulb.

16. The light assembly of claim 15, wherein said receiving and retaining means comprise a flexible spring clip.

17. The light assembly of claim 16, wherein said housing halves include recess means for accomodating said contacts within said housing when said housing halves are joined together by said fastening means.

18. The light assembly of claim 17, wherein said bulb-receiving portion comprises:

a U-shaped support for said spring clip, said clip extending from said U-shaped support upwardly along said axis; and a leg extending from said U-shaped support downwardly along said axis through said housing to form said external portion and terminating in said foot.

19. The light assembly of claim 18, wherein said foot flares outwardly from said leg.

20. The light assembly of claim 19, wherein said foot of each of said first and second contacts is spot welded to its respective one of said conductive elements.

21. A light assembly for wedge base bulbs, comprising:

two parallel, elongated, flexible, conductive elements;

a plurality of sockets mounted to said elements and adapted to receive wedge base bulbs;

means for holding said elements; and means coupled to said holding means for covering said elements and including aperture means through which said sockets extend in a direction substantially perpendicular to said conductive elements;

wherein said holding means comprises a raceway having two sides and a base, said base including recess means for accommodating said conductive elements.

22. The light assembly of claim 21, wherein said covering means comprises a U-shaped cover having a top and two walls depending downwardly therefrom, said cover being coupled to said raceway to form a hollow chamber between said raceway and said top.

23. The light assembly of claim 22, wherein:

said walls of said cover each have a lip at the lower edges thereof where said cover is coupled to said raceway; and each said side of said raceway has an indentation to reversibly mate and interlock with a corresponding lip.

24. The light assembly of claim 23, wherein each of said sockets comprises:

a housing having two substantially identical halves, a longitudinal axis, and a bulb-receiving portion adapted to receive the bulb substantially parallel to said axis;

means for fastening said housing halves together;

first and second substantially identical electrical contacts in said housing, said contacts being electrically separated and disposed within said housing such that each contact is oriented approximately 180° with respect to the other, measured about said axis;

said contacts each including an internal portion contained within said housing and an external portion extending along said axis outwardly from said housing to terminate in a foot substantially perpendicular to said axis, said foot of said first contact extending in a substantially opposite direction from said foot of said second contact.

25. The light assembly of claim 24, further comprising a mounting bracket having a bottom and two edges.

26. The light assembly of claim 25, wherein said raceway base further comprises raised strips that form at least one hollow chamber when the light assembly is coupled to said mounting bracket.

27. A light assembly for wedge base bulbs, comprising:

two parallel, flexible, elongated conductive elements;

a plurality of sockets mounted to said elements and adapted to receive wedge base bulbs;

said sockets each having a horizontal axis and a vertical axis, a housing including two housing pieces, and a bulb-receiving cavity adapted to receive a bulb substantially parallel to said horizontal axis;

means for fastening said housing pieces together; and first and second substantially similar electrical contacts in said housing, said contacts being electrically separated, disposed within said housing in a mirror-image relationship, and mounted to said conductive elements to extend in a cantilever manner along said vertical and horizontal axes.

28. The light assembly of claim 27, wherein said contacts each comprise:

an internal portion contained within said housing; and an external portion extending outwardly from said housing.

29. The light assembly of claim 28, wherein said external portion extends outwardly from said housing along said vertical axis.

30. The light assembly of claim 29, wherein said external portion terminates in a foot substantially perpendicular to said vertical axis.

31. The light assembly of claim 30, wherein said internal portion includes a bulb-receiving portion.

32. The light assembly of claim 31, wherein said bulb-receiving portion further comprises means for receiving and releasably retaining the bulb.

33. The light assembly of claim 32, wherein said means comprises a flexible spring clip.

34. The light assembly of claim 33, wherein said housing pieces include recess means for accomodating said contacts within said housing when said housing pieces are joined together by said fastening means.

35. The light assembly of claim 34, wherein said bulb-receiving portion comprises:

a U-shaped support for said spring clip, said clip extending from said U-shaped suport outwardly along said horizontal axis; and a leg extending from said U-shaped support first along said horizontal axis and then downwardly along said vertical axis through said housing to form said external portion and terminating in said foot.

36. The light assembly of claim 35, wherein said foot flares outwardly from said leg.

37. The light assembly of claim 36, wherein said foot of each of said first and second contacts is spot welded to its respective said conductive elements.

38. The light assembly of claim 37, wherein said leg includes reinforcing rib means for supporting said contact in a cantilever fashion on its associated conductive element.

39. A lighting assembly for wedge base bulbs, which comprises:

a plurality of sockets, each socket including a housing having two substantially identical halves, a longitudinal axis, and a bulb-receiving cavity adapted to receive a wedge base bulb;

means for fastening said housing halves together;

first and second substantially similar electrical contacts in each said housing;

said contacts each having an internal portion contained within said housing and an external portion extending outwardly from said housing;

said internal portion including a bulb-receiving portion;

said contacts being electrically separated and disposed within said housing; and means for both supporting said contacts and conducting electricity to said contacts comprising first and second substantially flat, elongated, parallel conductive elements, said elements being substantially flexible along the length thereof so that the lighting assembly may be flexed to follow a curved configuration, said external portion of said first and second contacts being physically and electrically coupled to said first and second conductive elements, respectively.

40. A lighting assembly as set forth in claim 39, wherein each of said first and second contacts is oriented approximately 180° with respect to the other measured about said longitudinal axis, the wedge base bulb adapted to be received parallel to said axis.

41. A lighting assembly as set forth in claim 39, wherein said first and second contacts are disposed within said housing in a mirror-image relationship and are mounted to said conductive elements to extend in a cantilever manner from said axis, the wedge base bulb adapted to be received perpendicular to said longitudinal axis.

* * * * *